United States Patent [19]

Williams

[11] 4,223,377

[45] Sep. 16, 1980

[54] ELECTRA BRICK

[76] Inventor: Henry Williams, 99 E. 91st St., Brooklyn, N.Y. 11212

[21] Appl. No.: 921,305

[22] Filed: Jul. 3, 1978

Related U.S. Application Data

[63] Continuation-in-part of Ser. No. 768,228, Feb. 14, 1977, abandoned.

[51] Int. Cl.[2] ..... F21S 1/02

[52] U.S. Cl. ..... 362/145; 362/362

[58] Field of Search ..... 362/145, 147, 148, 146, 362/150, 152, 362, 153, 151; 102/90

[56] References Cited

U.S. PATENT DOCUMENTS

| | | | |
|---|---|---|---|
| 2,216,220 | 10/1940 | Baker | 362/147 |
| 2,691,718 | 10/1954 | Bowers | 362/146 |
| 3,663,808 | 5/1972 | Baatz | 362/152 |
| 3,745,327 | 7/1973 | Lowery | 362/146 |

FOREIGN PATENT DOCUMENTS

| | | | |
|---|---|---|---|
| 2261223 | 12/1973 | Fed. Rep. of Germany | 102/90 |
| 2117101 | 9/1975 | Fed. Rep. of Germany | 362/362 |

*Primary Examiner*—Harold J. Tudor

*Attorney, Agent, or Firm*—Albert C. Nolte, Jr.; Edward B. Hunter

[57] ABSTRACT

A brick comprising in combination a body element having oppositely disposed ends and spaced apart surfaces intermediate the ends, with the body element having a pair of elongated cavities extending between the oppositely disposed ends and through the spaced apart surfaces and a channel extending between the cavities. An aperture extends between each cavity and a respective one of each of the ends. Electrical lighting components are mounted in each of the cavities and include a light bulb socket secured to a wall of the cavity, a light bulb secured in the socket, first electrical wires connected to each light bulb socket through the channel, and second electrical wires connected to each light bulb socket and exiting from the body element through each aperture, such that adjacent bricks may be wired together. A light transmitting closure assembly is removably secured to each of the spaced apart surfaces to fully enclose the sides of each cavity in the body element and the electrical lighting components in each of the cavities.

14 Claims, 4 Drawing Figures

ELECTRA BRICK

REFERENCE TO RELATED APPLICATIONS

This is a continuation-in-part of United States patent application Ser. No. 768,228 filed Feb. 14, 1977, now abandoned.

BACKGROUND OF THE INVENTION

The present invention relates to a masonry brick that is utilized for indoor and outdoor purposes and includes means associated therewith to illuminate the opposite surfaces thereof through a translucent lens. The present invention therefore permits the internal illumination of bricks to obtain various desired effects. By being able to incorporate within the brick the necessary lighting, a totally new concept in obtaining decor and lighting is obtained. Particular uses of the novel brick of the present invention are for use in fabricating a fireplace, masonry walls, walkways, steps, garage entrance, as well as in subway tunnels, etc. The brick of the present invention, since it emits light from both sides thereof, can be used in corridors, offices, restaurants, warning lights, and advertisements. Obviously, the brick and the lens itself may be provided in assorted colors and sizes.

The prior art sets forth certain devices related to the illumination of blocks or panels, as illustrated in U.S. Pat. Nos. 2,216,220, 3,543,014 and 3,745,327. I have found the units disclosed therein, to be deficient, in particular with respect to those outdoor applications where moisture can easily enter the light transmitting closure assembly.

The present invention, in contrast to the prior art, is further designed to facilitate ready replacement of the bulbs contained therein and electrically connecting the blocks together. The advantages and distinctions of my invention over the prior art will become more clearly evident as the disclosure proceeds.

An object of the present invention is to provide a luminous brick that may be used for internal and exterior building applications.

Another object of the present invention is to provide a brick having light emitted from both sides thereof and that may be used for both structural strength and decorative lighting.

Other objects and advantages of the present invention will become apparent as the disclosure proceeds.

SUMMARY OF THE INVENTION

A brick comprising in combination a body element having oppositely disposed ends and spaced apart surfaces intermediate the ends, with the body element having a pair of elongated cavities extending between the oppositely disposed ends and through the spaced apart surfaces and a channel extending between the cavities. An aperture extends between each cavity and a respective one of each of the ends.

Electrical lighting components are mounted in each of the cavities and include a light bulb socket secured to a wall of the cavity, a light bulb secured in the socket, first electrical wires connected to each light bulb socket through the channel, and second electrical wires connected to each light bulb socket and exiting from the body element through each aperture, such that adjacent bricks may be wired together.

A light transmitting closure assembly is removably secured to each of the spaced apart surfaces to fully enclose the sides of each cavity in the body element and the electrical lighting components in each of the cavities.

DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DESCRIPTION OF THE PREFERRED EMBODIMENT

Figure 1:
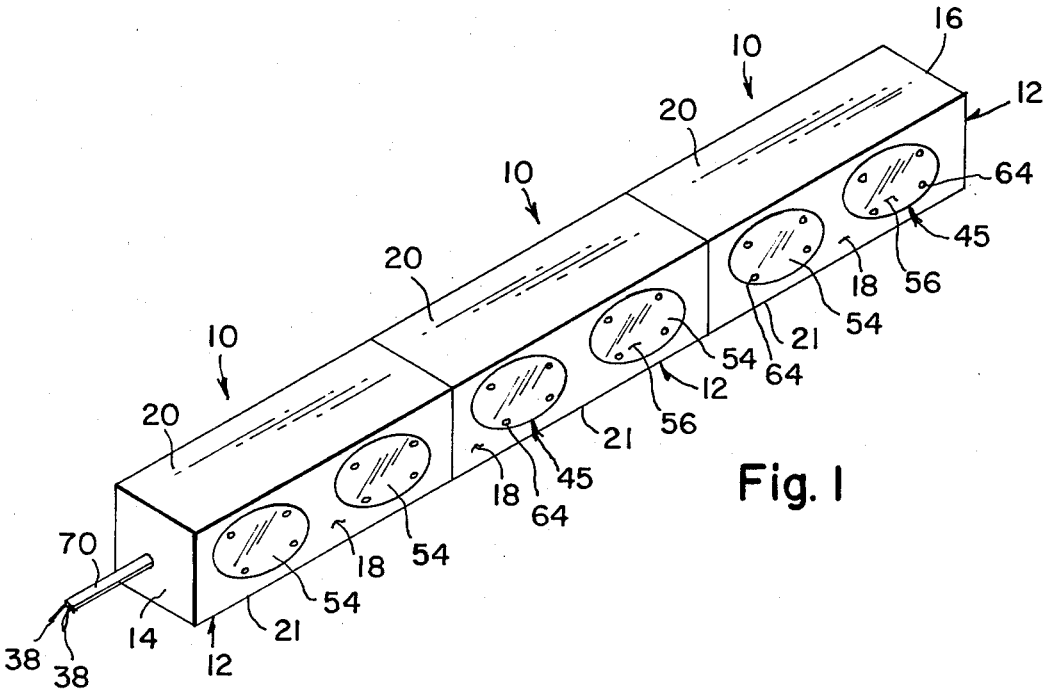
FIG. 1 is a perspective view illustrating bricks of the present invention in assembled relationship to each other.
Figure 2:
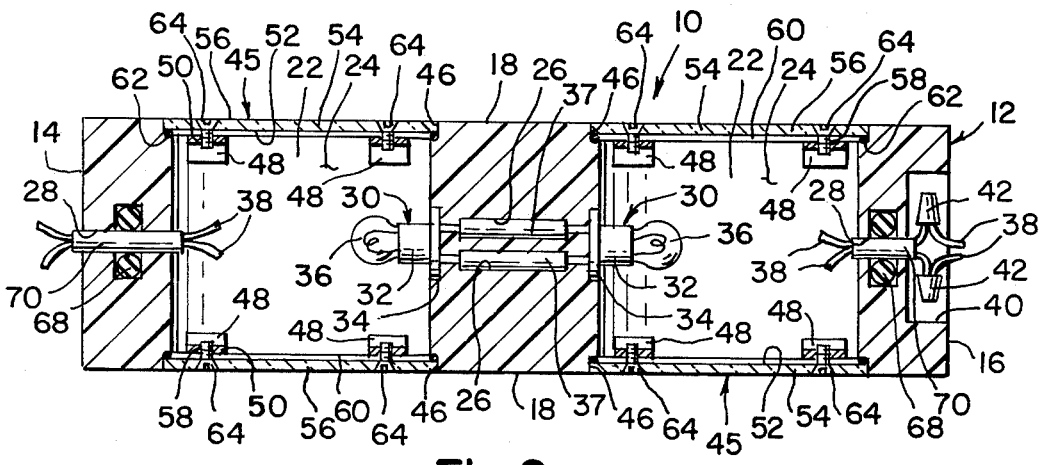
FIG. 2 is a sectional view of a single brick of the present invention.

Referring to the drawings, there is illustrated in FIGS. 1 and 2 a brick 10 that includes a body element 12 having oppositely disposed ends 14 and 16. Spaced apart surfaces 18 extend between the oppositely disposed ends 14 and 16. Each body element 12 further includes a top 20 and bottom 21 in spaced relationship to each other. The body element 12 may be of a rectangular configuration and of a size that is common to bricks well known in the masonry field.

Each body element 12, includes a cavity 22 extending between the oppositely disposed ends 14 and 16, and through the spaced apart surfaces 18. Two cavities 22 are illustrated in accordance with the preferred embodiment of the invention. Each cavity 22 has a cavity wall 24 that may be of an oval or rectangular configuration. A channel 26 extends between the cavities 22. Two channels 26 are illustrated in FIG. 2. To permit wiring of adjacent bricks 10, an aperture 28 is provided between each cavity 22 and a respective one of the ends 14 and 16.

In this manner it is possible to place the bricks in abutting relationship to each other such that various walls may be constructed for outdoor or indoor use. In general the body element 12 may be fabricated from masonry, wood, plastic, styrofoam, etc. If desired, cement may be used for securing the bricks together.

Electrical lighting means or components 30 are mounted in each of the cavities 22. The components 30 may include a light bulb socket 32 secured to the wall 24 of the cavity 22. The light bulb socket 32 may include a base 34 with the base 34 embedded within the wall 24. This may occur when the body element 12 is fabricated or subsequent thereto. A light bulb 36 may be provided in each socket 32. First electrical wires 37 are connected to each light bulb socket 32 through the channels 26.

Second electrical wires 38 are connected to each of the light bulb sockets 32 and exit from the body element 12 through each aperture 28. In this manner the adjacent bricks 10 may be wired together. The wiring is done in a manner well known in the art, such that the wires 38 on the end block or brick 10 may be connected to a conventional source of electrical current. The bulbs 36 may be wired in series or in parallel.

To aid in positioning the bricks 10 adjacent each other, there is provided a chamber 40 in at least one end 16. The chamber 40 communicates with the cavity 22 by means of aperture 28. The chamber 40 is dimensioned and adapted to receive therein a pair of electrical caps 42 for wiring or coupling together the second electrical wires 38 of an adjacent brick. This provides a convenient manner to wire the bricks 10 together.

For the transmission of the light from within each brick 10 there is provided a light transmitting closure assembly 45 associated with each cavity 22 at each end thereof. Each closure assembly 45 fully encloses the cavity 22 and the electrical lighting components 30 contained therein. The closure assembly 45 includes a peripheral recess 46 on each of the spaced apart surfaces 18 circumferentially of each cavity 22. A pair of brackets 48 are contained in each cavity 22 adjacent a respective surface 18. Each bracket 48 includes a flange 50 extending in substantially parallel spaced relationship to the inner surface 52 of lens 54. The lens 54 also has an outer surface 56, and the lens is dimensioned to fit within the confines of the recess 46. The recess 46 may be oval in shape, and each lens may have a similar oval configuration.

To support each lens 54, a threaded aperture 58 extends through the flange 50. Each lens 54, which may be translucent to permit light to pass therethrough extends within each recess 46. The lens 54 may be fabricated from plexiglass or other material capable of transmitting light therethrough. The lens may be of various colors.

To prevent moisture from entering the cavity 22, a sealing gasket 60 is interposed between the lens 54 and the recess inner wall 62. The sealing gasket 60 conforms to the shape of the cavity recess 46. The sealing gasket 60 may be fabricated from rubber or other similar material. Four screws 64 are associated with each lens or panel 54 and received in the associated aperture 58.

The thickness of the gasket 60, and the lens 54, is dimensioned relative to the depth of recess 46 as defined by the wall 62, so that the outer surface 56 of the lens 54 is in a plane substantially flush with the surface 18. The screw 64 may be countersunk to extend in a plane substantially flush with the outer surface 56 of the lens 54.

To further assure that moisture does not enter the cavity 22, a sealing O-ring or member 68 is provided along each aperture 28 between the cavity 22 and the respective end 14 or 16. The O-ring 68 is adapted to engage the second electrical wires 38 which may be contained in an insulated outer sleeve 70.

In this manner a new and novel electrified brick has been provided that is adapted to be used for structural and decorative purposes. In each case the bracket 48 may be secured to the wall 24 of each cavity 22 in a conventional manner. The bulbs 36 may be of the blinking or steady light type. When a bulb has to be replaced, the screws 64 are removed and access thereto is obtained.

Figure 3:
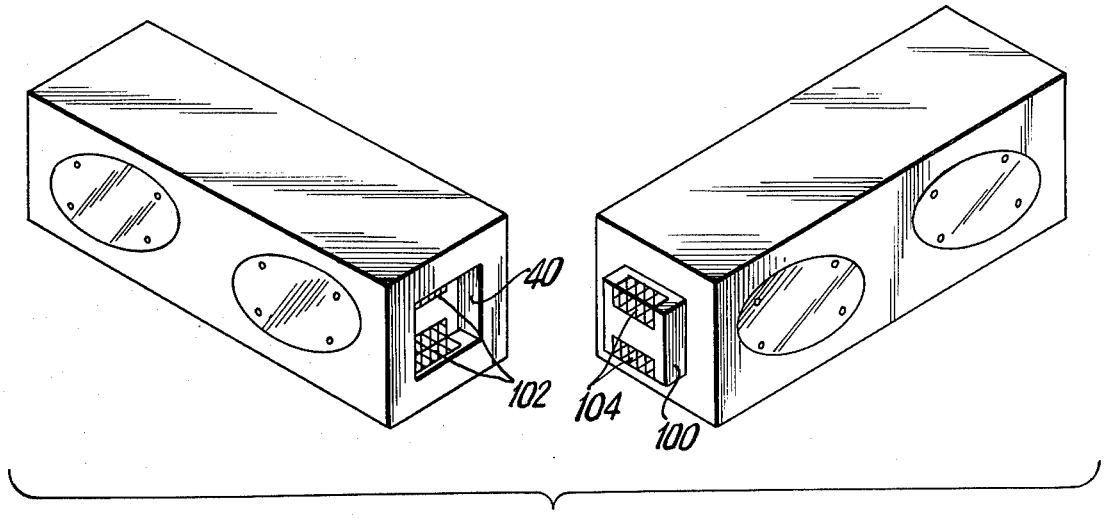
FIG. 3 is a perspective view of two blocks according to this invention.

The blocks of FIG. 3 are in many respects similar to those of FIGS. 1 and 2, however, the blocks are provided at one end with a recess 40 of rectangular form while at the other end there is provided a protruding configuration 100 of complementary shape and size to recess 40. Within the recess or chamber 40 there are provided electrical terminal means 102 and complementary electrical terminal means 104 are provided on configuration 100. The blocks in FIG. 3 may be assembled end to end by inserting configuration 100 into chamber 40 and in that process an electrical connection is made between the terminals 102 and 104.

Figure 4:
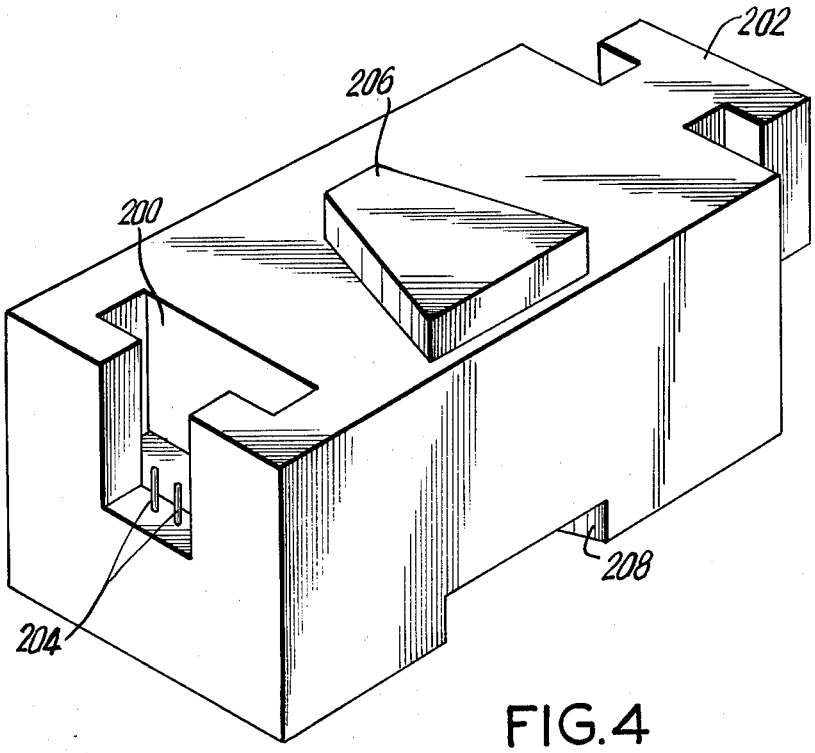
FIG. 4 is a perspective view of an alternative form of block according to the present invention.

The block illustrated in FIG. 4 comprises at one end a T-section chamber or recess 200 and at its opposite end a correspondingly shaped protruding configuration 202. In the particular embodiment illustrated a pair of electrical terminal pins 204 are disposed in the chamber 200 and corresponding pin receiving openings, not visible in the drawings, are provided in the configuration 202 so that similar bricks may be joined end to end with the pins 204 engaged in the corresponding pin receiving openings of the configuration 202 to complete an electrical circuit. It will be appreciated that if desired the pins may be disposed upon the configuration 202 while corresponding openings would be provided in the chamber 200.

Formed upon the upper surface of the block is a generally wedge shaped protruding configuration 206 and in the bottom surface of the block there is a correspondingly shaped recess or chamber 208. By engaging configuration 206 in chamber 208 of a similar block, it is apparent that the blocks can be securely stacked. If desired, the configuration 206 and chamber 208 may be provided with electrical connection means to facilitate the completion of an electrical circuit between stacked blocks.

Additionally, it will be recognized that the configuration 206 may take the form of a T-section protrusion and the chamber 208 will, of course, be correspondingly shaped.

Although illustrative embodiments of the invention have been described in detail herein with reference to the accompanying drawings, it is to be understood that the invention is not limited to the precise embodiments and that various changes and modifications may be effected therein without departing from the scope or spirit of the invention.

What is claimed is:

1. A brick, comprising in combination:

a. a body element having oppositely disposed ends and spaced apart surfaces intermediate said ends, b. said body element having a pair of elongated cavities extending between said oppositely disposed ends and through said spaced apart surfaces said cavities being separated by a wall intermediate said end and extending between said surfaces, c. a channel extending between said cavities and through said wall, d. an aperture extending between each said cavity and a respective one of each said ends, e. electrical lighting components mounted in each of said cavities and including:

(1) a light bulb socket secured to said wall of said cavity, (2) a light bulb secured in said socket, (3) first electrical wires connected to each said light bulb socket through said channel, and (4) second electrical wires connected to each said light bulb socket and exiting from said body element through each said aperture, such that adjacent bricks may be wired together in end to end relationship, f. a light transmitting closure assembly removably secured to each of said spaced apart surfaces to fully enclose the sides of each said cavity in said body element and said electrical lighting components in each of said cavities, said assembly including:

(1) a peripheral recess on each of said spaced apart surfaces circumferentially of each of said cavities, (2) at least one pair of brackets in each of said cavities having a threaded aperture therein, (3) a sealing gasket in each of said recesses and substantially conforming to the shape of said cavity, (4) a translucent lens extending in each said recess in abutting engagement with said gasket, and (5) at least one pair of screws extending through each said lens and received through said threaded aperture in each of said brackets, such that said lens may be removed as required and wherein, g. a chamber on an external surface of one of said ends, said chamber communicating with said cavity by means of said aperture, said chamber adapted to receive therein a pair of caps for coupling together respective second electrical wires of adjacent bricks and to constitute means facilitating the disposition of said bricks in end to end, abutting relationship.

2. A brick as in claim 1, wherein said body element is of a substantially rectangular configuration.

3. A brick as in claim 1, wherein said recess is of a depth such that said lens is substantially flush with its mating one of said surfaces.

4. A brick as in claim 3, wherein said screw is countersunk to extend in a plane substantially flush with the outer surface of said lens.

5. A brick as in claim 1, wherein:

a. each said recess is oval in shape, and b. each said lens is of similar oval configuration.

6. A brick as in claim 1, and including a sealing O-ring extending in each said aperture between said cavity and one of said ends, each said O-ring adapted to engage one of said second electrical wires.

7. A brick as in claim 1, wherein each said light bulb socket includes a base, and said base is embedded within the wall of said cavity.

8. A brick as in claim 1, wherein each of said brackets includes a flange extending in substantially parallel spaced relationship to the inner surface of said lens, said threaded aperture extending in each said flange.

9. A brick as in claim 1, wherein each said lens is fabricated from plexiglass.

10. A brick, comprising in combination:

a. a body element having oppositely disposed ends and spaced apart surfaces intermediate said ends, b. said body element having at least one elongated cavity extending between said oppositely disposed ends and through said spaced apart surfaces, c. an aperture extending between said at least one cavity and said ends, d. electrical lighting components mounted in said at least one cavity and including:

(1) a light bulb socket secured to a wall of said cavity, (2) a light bulb secured in said socket, (3) first electrical wires connected to each said light bulb socket through said aperture, such that adjacent bricks may be wired together in end to end relationship, e. a light transmitting closure assembly removably secured to each of said spaced apart surfaces to fully enclose the sides of said at least one cavity in said body element and said electrical lighting components in said at least one cavity, said assembly including:

(1) a peripheral recess on each of said spaced apart surfaces circumferentially of said at least one cavity, (2) at least one pair of brackets in said at least one cavity having a threaded aperture therein, (3) a sealing gasket in each of said recesses and substantially conforming to the shape of said cavity, (4) a translucent lens extending in each said recess in abutting engagement with said gasket, and (5) at least one pair of screws extending through each said lens and received through said threaded aperture in each of said brackets, such that said lens may be removed as required and wherein, f. a chamber on an external surface of one of said ends, said chamber communicating with said at least one cavity by means of said aperture, said chamber being adapted to receive therein means for coupling together respective first electrical wires of adjacent bricks and to constitute means facilitating the disposition of said bricks in end to end, abutting relationship.

11. A brick as claimed in claim 10 wherein said end of said brick opposite to said one end comprises a projecting configuration including electrical terminal means, said configuration having a shape complementary to said chamber, said configuration and chamber constituting male and female elements respectively by which like bricks are joined in end to end relationship, said terminal means of said configuration cooperating with corresponding terminal means of said chamber to complete an electrical connection.

12. A brick as claimed in claim 11 wherein said configuration comprises an enlarged head portion connected to said end opposite said one end by a neck portion and said chamber is correspondingly shaped and opens to one of said spaced apart surfaces, said head portion cooperating with a corresponding part of said chamber to prevent separation of joined bricks other than by relative transverse movement thereof.

13. A brick as claimed in claim 12 wherein said configuration is of T section.

14. A brick as claimed in claim 12 wherein opposite ones of said spaced apart surfaces are provided with interengaging connecting means permitting the connection of said bricks in side by side and stacked relationship.

* * * * *